US008212725B2

(12) United States Patent
Pons et al.

(10) Patent No.: US 8,212,725 B2
(45) Date of Patent: Jul. 3, 2012

(54) METHOD FOR PRODUCTION OF CHIP-INTEGRATED ANTENNAE WITH AN IMPROVED EMISSION EFFICIENCY

(75) Inventors: Michel Pons, Meylan (FR); Frédéric Lemaire, Saint Egreve (FR)

(73) Assignee: STMicroelectronics SA, Montrouge (FR)

( * ) Notice: Subject to any disclaimer, the term of this patent is extended or adjusted under 35 U.S.C. 154(b) by 997 days.

(21) Appl. No.: 11/281,744

(22) Filed: Nov. 17, 2005

(65) Prior Publication Data

US 2006/0158378 A1 Jul. 20, 2006

(30) Foreign Application Priority Data

Nov. 17, 2004 (FR) ..... 04 52663

(51) Int. Cl.
*H01Q 1/38* (2006.01)
*H01Q 9/28* (2006.01)

(52) U.S. Cl. ..... 343/700 MS; 343/795

(58) Field of Classification Search ..... 343/700 MS, 343/793, 795, 788, 870, 753, 762, 779, 745, 343/773; 336/65, 200; 257/506, 510, 516, 257/538, 659
See application file for complete search history.

(56) References Cited

U.S. PATENT DOCUMENTS

| | | | | |
|---|---|---|---|---|
| 5,091,731 | A * | 2/1992 | Rees | 343/700 MS |
| 5,386,215 | A | 1/1995 | Brown | 343/795 |
| 5,432,374 | A * | 7/1995 | Norton | 257/442 |
| 5,631,489 | A * | 5/1997 | Roser | 257/449 |
| 6,285,066 | B1 * | 9/2001 | Meyer | 257/506 |
| 6,373,121 | B1 * | 4/2002 | Pan | 257/531 |
| 6,838,746 | B2 * | 1/2005 | Brenner | 257/510 |
| 6,842,144 | B2 * | 1/2005 | Guo et al. | 343/700 MS |
| 7,002,233 | B2 * | 2/2006 | Butaye et al. | 257/531 |
| 7,064,645 | B2 * | 6/2006 | Kobayashi et al. | 336/200 |
| 7,088,964 | B2 * | 8/2006 | O | 455/90.3 |
| 7,122,891 | B2 * | 10/2006 | Dishongh et al. | 257/700 |
| 7,180,450 | B2 * | 2/2007 | Gloria et al. | 343/700 MS |
| 7,247,922 | B2 * | 7/2007 | Yeh et al. | 257/516 |
| 7,342,299 | B2 * | 3/2008 | Gaucher et al. | 257/674 |
| 7,429,779 | B2 * | 9/2008 | Itoi et al. | 257/528 |
| 2004/0219895 | A1 * | 11/2004 | O et al. | 455/121 |
| 2006/0157798 | A1 * | 7/2006 | Hayashi et al. | 257/374 |

FOREIGN PATENT DOCUMENTS

| | | |
|---|---|---|
| EP | 1320122 | 6/2003 |
| JP | 04145705 | 5/2002 |

OTHER PUBLICATIONS

"On-Chip Integration of Dipole Antenna and VCO using Standard BiCMOS Technology for 10 GHz Applications", Touati et al., European Solid-State Circuits, 2003. ESSCIRC '03. Conference on Sep. 16-18, 2003, Piscataway, NJ, USA, IEEE, Sep. 16, 2003, pp. 493-496, XP010677401, ISBN: 0-7803-7995-0.

* cited by examiner

*Primary Examiner* — Hoanganh Le
(74) *Attorney, Agent, or Firm* — Allen, Dyer, Doppelt, Milbrath & Gilchrist, P.A.

(57) ABSTRACT

The method is to fabricate a microelectronic device with an integrated antenna. This method may include forming at least a first semiconducting layer on a substrate, forming in at least one zone of the first semiconducting layer of a structure to limit the circulation of current in the zone of the first semiconducting layer, forming a plurality of layers on the semiconducting layer and at least one antenna in the plurality of layers, with the antenna being formed opposite the zone. The antenna may be operable at radio frequencies above 10 GHz, and may have an improved emission efficiency.

23 Claims, 5 Drawing Sheets

METHOD FOR PRODUCTION OF CHIP-INTEGRATED ANTENNAE WITH AN IMPROVED EMISSION EFFICIENCY

FIELD OF THE INVENTION

The invention concerns the field of microelectronics, and, more particularly, concerns that of microelectronic devices such as, for example, integrated circuits or MEMS (MEMS for "microelectronic mechanical system") comprising one or more integrated antennae.

BACKGROUND OF THE INVENTION

Microelectronic devices, such as chips or MEMS, have recently been developed in which at least one antenna is integrated together with other components in a stack of thin layers formed on a semiconducting substrate. It is thus for example possible, in a radio frequency front-end type device, to adapt an antenna directly to a PA circuit (PA for "Power Amplifier") or an LNA circuit ("LNA" for "Low Noise Amplifier").

One advantage relating to the production of chip-integrated antennae can be, notably, to reduce the cost of manufacture of the radio frequency microelectronic devices. When directly integrated antennae are formed, it is possible notably to avoid the steps of mounting or assembly of these antennae, and by the same token to avoid certain negative effects relating to this assembly on the electrical performance specifications of the chip. Another advantage relating to this integration is that a number of components external from the chip are eliminated.

Over recent years many short-range systems of communicating objects have been created, using standards such as the "Bluetooth" or "802.11" standard, operating at frequencies on the order of several GHz, for example 2.4 GHz. At the current time it is envisaged, for this type of system of communicating devices, or for applications of the PAN type (PAN for "Personal Area Network") to use frequencies above those of the abovementioned current standards, for example frequencies of over 10 GHz, or frequencies belonging to another part of the spectrum reserved to ISM (Industrial, Scientific, Medical) applications located around 24 GHz. Use of such ranges of frequencies implies the formation of even smaller antennae than previously, and makes devices with antennae integrated directly in chips even more attractive.

However, chip-integrated antennae have performance specifications inferior to those of external or "free space" antennae. The emission efficiency of an integrated antenna, defined as the ratio of the emitted power of the antenna over the electrical incident power injected into this antenna to provide this emission, is, notably, low compared to that of an antenna in free space, being for example on the order of 10% at 10 GHz or 25% at 20 GHz.

The problem of finding a technique enabling the emission efficiency of chip-integrated antennae to be improved is thus posed.

SUMMARY OF THE INVENTION

The present invention proposes a method for fabricating a microelectronic device with an integrated antenna with an improved emission efficiency compared to the devices of the prior art.

The invention concerns a method for fabricating a microelectronic device with integrated antenna comprising:

a) supplying a substrate covered with a semiconducting layer or a doped semiconducting layer, b) forming in a zone of the semiconducting layer a structure or means for limiting the circulation of current in this layer, c) forming a set or a plurality of layers on the semiconducting layer, and at least one antenna in the plurality of layers, the antenna being formed at least in part opposite or above the zone and the structure for limiting circulation of current.

Thus, elements are positioned in the semiconducting layer to increase the resistance of this layer in a zone opposite the antenna to improve the emission efficiency of the antenna.

According to one variant, prior to step a) the method may include the formation of the semiconducting layer on the substrate by an epitaxy or several successive epitaxies.

The antenna may possibly be formed from a dipole with two separate conducting branches. In step c), each of the conducting branches may be formed, at least in part opposite the structure or means for limiting the circulation of current in the zone of the semiconducting layer.

According to a first particular embodiment, the means or structure for limiting the circulation of current may include one or more insulating blocks inserted in the semiconducting layer and located opposite the antenna.

The antenna may be intended to occupy a predetermined position relative to the substrate. Thus, according to a variant of this first particular embodiment of the invention, step b) may include the following steps: formation of a mask on the semiconducting layer with one or more openings positioned in function of the predetermined position, etching of the semiconducting layer through the mask to form holes, and filling of the holes using a dielectric material to form the insulating blocks, such that the blocks or a set of blocks may occupy positions in the semiconducting layer designed such that they are at least partially opposite the antenna.

According to a second embodiment, the means or structure for limiting the circulation of current may include one or more junctions formed in the zone of the first semiconducting layer and located opposite the antenna.

The antenna may be intended to occupy a predetermined position relative to the substrate. Thus, according to a variant of the second embodiment, step b) may include the following steps: formation of a mask on the semiconducting layer with one or more openings positioned as a function of the predetermined position, and one or more steps of doping of the semiconducting layer through the mask to form the junctions, such that the junctions or several junctions may occupy a position in the semiconducting layer designed to be at least in part opposite the antenna. The junctions may be PN junctions. The semiconducting layer may be doped according to a given type of doping, for example P type doping or N type doping.

According to a variant, the junctions may be PN junctions fabricated by formation in the semiconducting layer of regions or zones having a type of doping different from the given type of doping, for example an N type doping or a P type doping.

The invention also concerns a microelectronic device with an integrated antenna comprising a substrate, at least one doped semiconducting layer lying on the substrate, a structure or means for limiting the circulation of current in a least one given zone of the semiconducting layer, and an antenna formed in a least one layer of a plurality of thin layers lying on the semiconducting layer, with the antenna being located at least partially opposite or above the given zone. The doped semiconducting layer may be a layer obtained for example by epitaxy.

According to a first variant of implementation of the device, the structure or means for limiting the circulation of current may include one or more insulating blocks fabricated in the semiconducting layer and located opposite the antenna.

According to a second variant of implementation of the device, the means or structure for limiting the circulation of current may comprise several junctions located opposite the antenna. The above-mentioned junctions may be PN junctions.

According to a particular embodiment of the device, the antenna may comprise a dipole formed of two branches with a conducting material base, where each of the branches is located at least in part opposite the structure or means for limiting the circulation of current in the given zone of the semiconducting layer.

The microelectronic device with the integrated antenna according to the invention may form part of a MEMS or a chip. The antenna of the microelectronic device with the integrated antenna according to the invention, may be designed to emit at frequencies above 1 GHz, for example at frequencies in a frequency range above 10 GHz, or at frequencies of at least 15 GHz, or at frequencies of at least 20 GHz. A microelectronic device with the integrated antenna designed to emit according to frequencies belonging to a band of ISM frequencies around 24 GHz may be implemented.

A communicating object device may also be envisaged that is suitable for communicating via a wireless link, such as a mobile terminal able to communicate via a wireless link, a device such as a peripheral and/or an electronic device able to communicate by radio link with other devices in a PAN network (PAN for "Personal Area Network"), each having a microelectronic device with the integrated antenna.

An improved microelectronic device comprising the integrated antenna and a method for fabricating such a microelectronic device and its integrated antenna are proposed. The antenna may find applications notably in the field of short- or very short-range communications, for example, for communicating devices or systems using frequencies on the order of, for example, 10 GHz and above.

BRIEF DESCRIPTION OF THE DRAWINGS

The present invention will be better understood on reading the description of examples of embodiment given, purely as an indication and in no way limiting, making reference to the annexed illustrations in which.

DETAILED DESCRIPTION OF THE PREFERRED EMBODIMENTS

Identical, similar or equivalent parts of the different figures have the same numerical references, to facilitate changing from one figure to another. The different parts represented in the figures are not necessarily represented according to a uniform scale, in order to make the figures more readable. An example of a method of embodiment of a microelectronic device implemented according to the invention will now be described in connection with FIGS. 1A-1E.

This device may be formed from a substrate and is intended to be fitted with an integrated antenna, for example in the form of a dipole, which will be fabricated in thin layers on the substrate. This dipole may be designed to have a certain position relative to the substrate, and a certain size as a function of the working frequency at which it is desired to operate this dipole. As an example, the technology of embodiment of this device may be a BiCMOS technology (BICMOS for "Bipolar Complementary Metal-Oxide Semi-conductor").

The initial material of the method is a semiconducting substrate 100, comprising a first semiconducting material, for example silicon of thickness on the order of 350 μm. The substrate 100 may have a resistivity of at least 15 Ωcm, and preferably over 50 Ωcm, to enable the antenna to have an improved operation.

Figure 1A:
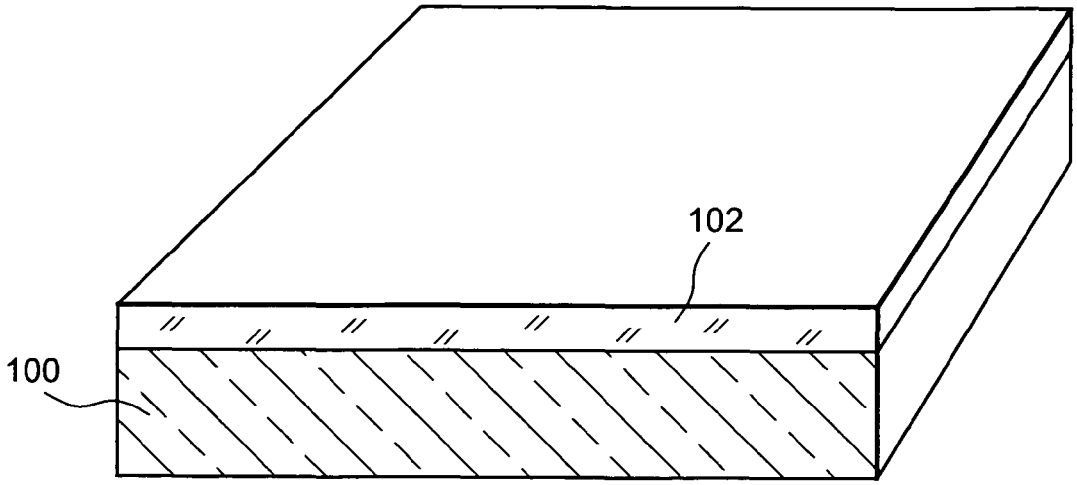
FIGS. 1A-1E, represent different steps of a first example of a method implemented according to the invention, for production of a microelectronic device with an integrated antenna.

A growth of a layer 102 of thickness for example on the order of 900 nm and comprising a second semiconducting material, for example silicon, is firstly fabricated on substrate 100. This growth may be effected by an epitaxy or several successive epitaxies, such that layer 102 is doped and may have a resistivity for example on the order of 0.6 Ωcm (FIG. 1A).

In a layer 104, for example with a base of a dielectric material such as $SiO_2$ or $Si_3N_4$, and/or a photosensitive resist which is deposited on the semiconducting layer 102, a mask 105 is then fabricated, for example by photolithography followed by etching. This mask 105 has a set of openings revealing the semiconducting layer 102. In a given region of mask 105 particular openings 107 are notably formed. This region has a position in layer 104, which depends on the predetermined position, relative to substrate 100, of the antenna dipole, intended to be fabricated subsequently above the semiconducting layer 102. The particular openings 107 thus have a positioning in the area of mask 105 which is suitable for the predetermined position of the dipole relative to the substrate 100. The extent of the region of mask 105 in which the particular openings 107 are fabricated and/or the size of these openings 107 can also be designed according to the predetermined size of the dipole.

Figure 1B:
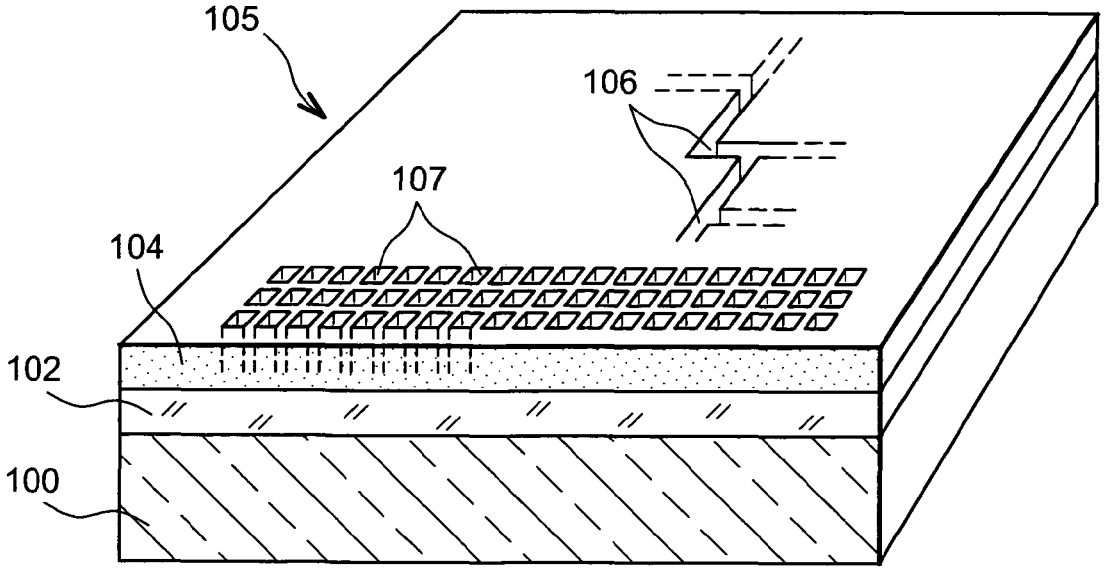

The openings 107 may be fabricated during the same step as other patterns in layer 104, for example slits 106. The openings 107 may be, for example, rectangular in shape or square in shape, on the order of several micrometers each side, for example between 1 μm and 10 μm, and be spaced by a gap for example on the order of several micrometers between 1 and 10 μm (FIG. 1B).

Figure 1C:
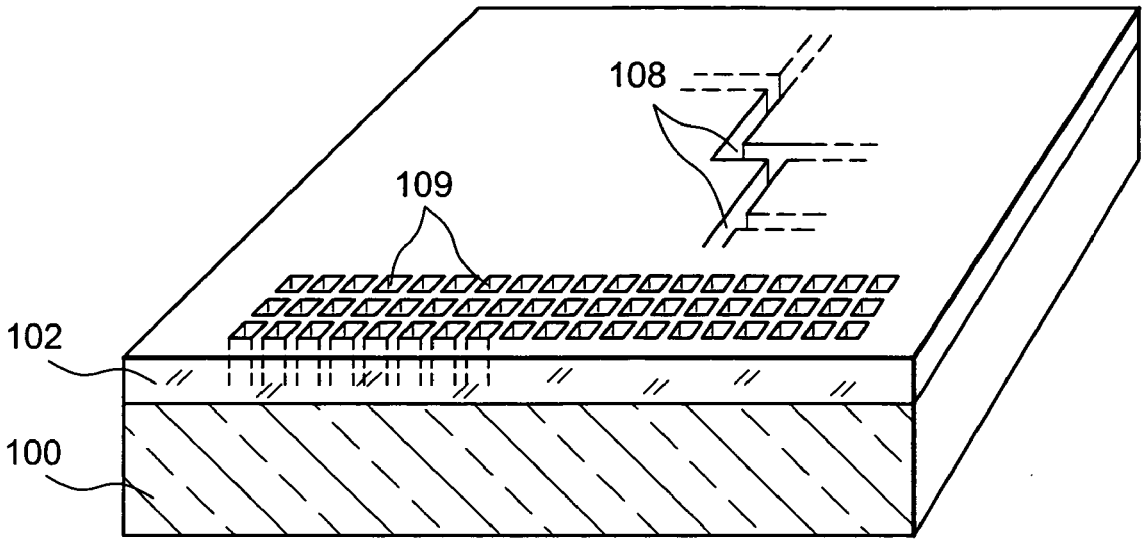

An etching of the semiconducting layer 102 is then performed through the slits 106 and the openings 107 of the mask 104 to form respectively trenches 108 and holes 109. In the extension of the particular openings 107, holes 109 are formed occupying positions in layer 102 suitable for the future position, notably relative to the substrate 100, of the antenna dipole. The holes 109 may also each be of a size suitable for the predetermined size of the dipole. The mask 104 is then removed (FIG. 1C).

A step of filling of the holes 109 and of the trenches 108 may then be accomplished using a dielectric material, for example comprising $SiO_2$. The filled trenches 108 may act as lateral insulations, commonly called "deep trenches", in a direction parallel to a main plane of substrate 100, between integrated circuits intended to be formed from, or partially in, semiconducting layer 102.

The filled holes 109, for their part, form dielectric blocks 110 in the semiconducting layer 102. These blocks 110 are able, within a given zone of the semiconducting layer 102, to limit the circulation of the charge carriers.

In the following steps of the method, active zones notably for transistors are formed in the semiconducting layer 102. The semiconducting layer 102 is then covered with a set or plurality of layers 112 (represented by dashed lines in FIG. 1D) of dielectric layers and conducting layers, in which, using notably traditional steps of photolithography and etching, a set of components and interconnections are fabricated. These components (not represented) may be distributed for example over 5 different levels of metal formed in the etched conducting layers, and linked between one another by vertical interconnections, commonly called "vias". The levels of metal are insulated between one another by the dielectric layers.

Among the components fabricated may be components of a radio frequency front-end device commonly called "RF front-end" such as a LNA device or circuit (LNA for "Low Noise Amplifier") or a PA device or circuit (PA for "Power Amplifier") intended to be linked to the antenna dipole.

Figure 1D:
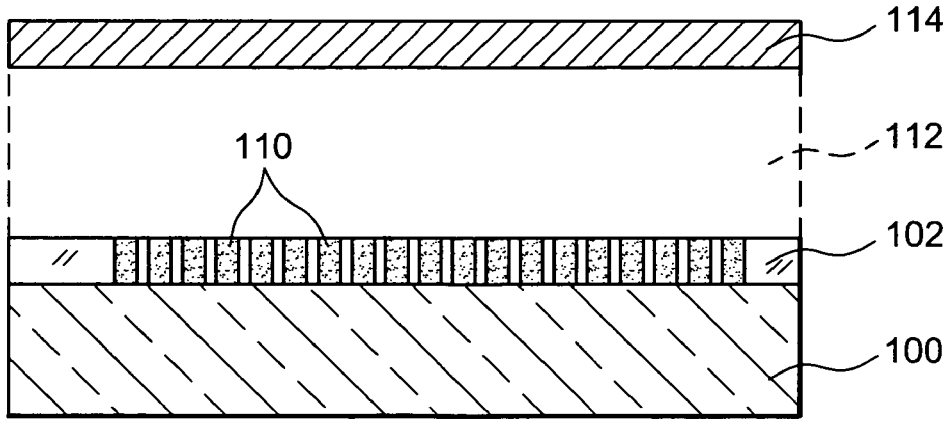

A metal layer 114 is then deposited on the set of layers 112. This layer 114 may be, for example, an aluminium-based layer of thickness on the order of 2.5 μm (FIG. 1D). In the metal layer 114 two separate metal branches 120 and 130 are fabricated, for example by photolithography, which are parallelepipedic in shape, one being an extension of the other.

The branches 120 and 130 are formed opposite or facing the zone of the semiconducting layer 102, in which the insulating blocks 110 are shown, such that each branch 120 or 130 may be located at least in part opposite or facing several insulating blocks 110.

Figure 1E:
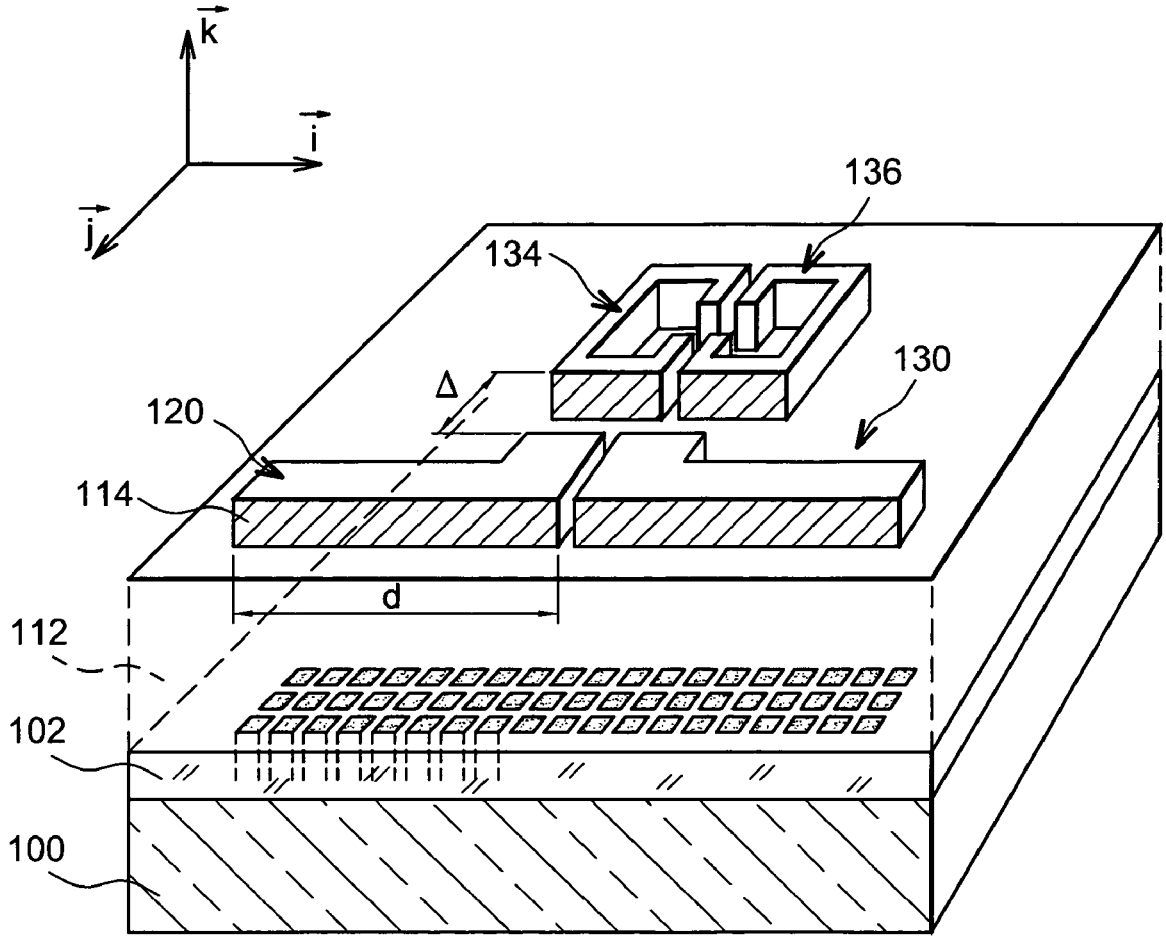

Branches 120 and 130 are intended to make a dipole or antenna doublet and can each have a length d, measured in a direction (defined in FIG. 1E by axis $\vec{i}$ of an orthogonal marker [O; $\vec{i}$; $\vec{j}$; $\vec{k}$]) parallel to a main plane of substrate 100, equal to one quarter the guided wavelength of the signal intended to be emitted by the antenna. Length d, which is dependent on the working frequency at which it is desired to operate this dipole, can, for example, be on the order of a few millimeters, for example on the order of 3.4 millimeters.

The insulating blocks 110 enable the circulation of current in the zone of the semiconducting layer 102 located opposite the antenna to be limited. The antenna can in this manner have improved emission efficiency. The branches are intended to be linked to a front-end radio device through vertical interconnections (not represented) formed in the set of layers 112.

Inductors 134 and 136 belonging to a radio front-end device circuit can also have been formed in metal layer 114 at the same time as dipole branches 120 and 130. These inductors 134 and 136 can have been fabricated such that each of them is a distance A, on the order of, for example, 200 μm from the branches 120 and 130, to limit coupling effects with the dipole (FIG. 1E).

Figure 2:
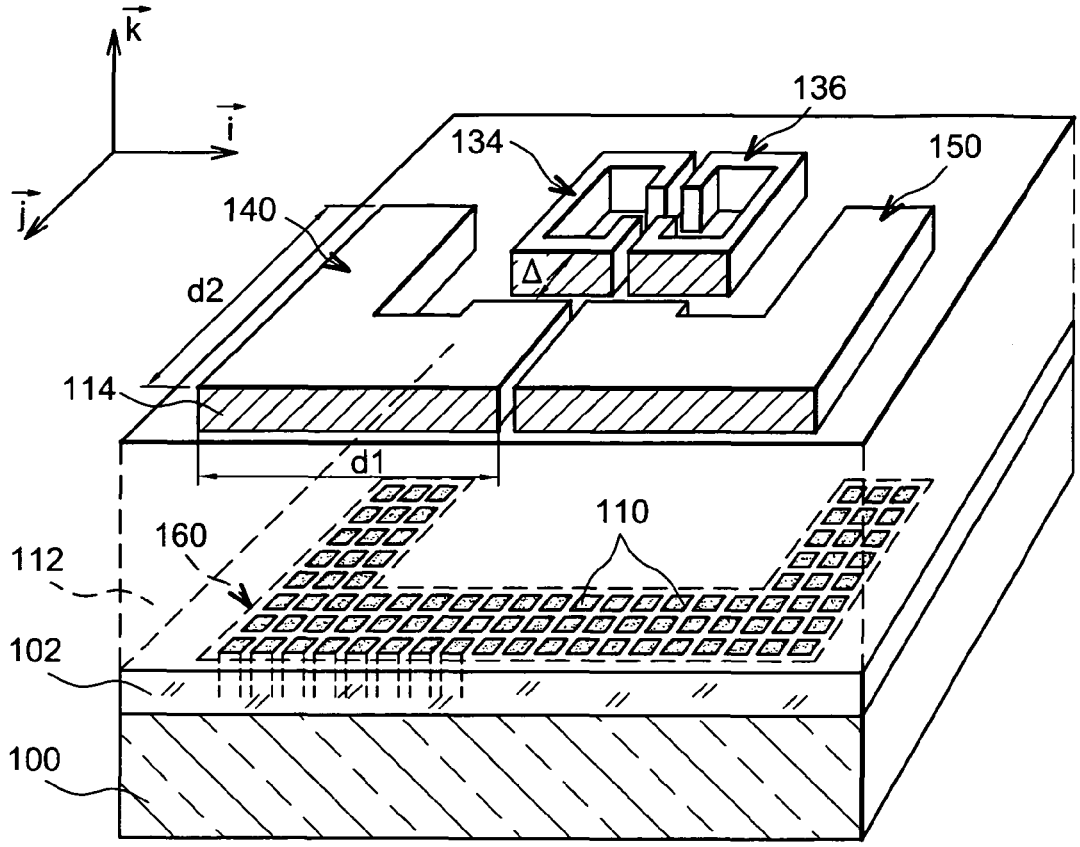
FIG. 2 represents an example of a microelectronic device implemented according to the invention, with an integrated antenna.

Another example of a microelectronic, different from the one the embodiment of which has just been described, is represented in FIG. 2. This device comprises a substrate 100 with a semiconducting material base, which can, for example, be silicon, or another semiconducting material. This substrate 100 is covered by a doped semiconducting layer 102, for example on the order of 1 μm thick, in which are inserted blocks 110, which are for example cubic or parallelepiped shape, with a dielectric material base, for example $SiO_2$.

The blocks 110 may have a width, measured in a direction parallel to a main plane of the substrate, on the order of 5 μm, and be separated one from another by a distance on, for example, the order of 5 μm.

Above the semiconducting layer 102 lies a set 112 of layers (represented in the diagram by a block with dashed lines), in which components and interconnections are formed. Among the components are components of a radio frequency front-end device.

In a metal layer 114 lying on the set of layers 112 a dipole is, notably, fabricated. This dipole differs from the one described previously in connection with FIG. 1E, in that it is formed from two curved branches 140 and 150, for example in an "L" shape, each comprising a part in the form of a parallelepipedic bar of length $d_2$ (defined in FIG. 2 in a direction parallel to axis $\vec{i}$ of an orthogonal marker [O; $\vec{i}$; $\vec{j}$; $\vec{k}$]) for example on the order of 2.5 mm, together with another part form from another parallelepipedic bar of length $d_1$ (defined in FIG. 2 in a direction parallel to axis $\vec{j}$ of the orthogonal marker [O; $\vec{i}$; $\vec{j}$; $\vec{k}$]) for example on the order of 0.9 mm, where the length ($d_1$+$d_2$) is equal to one quarter the guided wavelength of the signal intended to be emitted by the antenna.

The "L"-shaped curved branches 140 and 150 are located opposite or facing a zone 160 (defined by dashed lines in FIG. 2) of semiconducting layer 102, in which the insulating blocks 108 are grouped. The shape of the dipole follows that of the outline of zone 160. The dipole and zone 160 are, moreover, aligned with a direction orthogonal to a main plane of the substrate (and parallel to axis $\vec{k}$ of the orthogonal marker [O; $\vec{i}$; $\vec{j}$; $\vec{k}$] in FIG. 2), such that each of the branches 140 and 150 is located opposite a set of insulating blocks 110 of semiconducting layer 102.

In zone 160 located opposite semiconducting layer 102, the circulation of the charge carriers can thus be limited using blocks 110 relative to the remainder of layer 102. The branches of the antenna dipole can be of a different shape from those which have just been described in relation with FIGS. 1E and 2, while remaining in accordance with the invention.

According to a variant of the device described above in relation to FIG. 2, it is possible to have, in the place of the insulating blocks 110, a set of junctions located in the semiconducting layer, opposite or facing the dipole. An example of a method for fabricating such a device will now be described in relation with FIGS. 3A-3C.

According to a first step of this method, firstly the growth of a semiconducting layer 202 is fabricated, for example on the order of 900 nanometer thickness, on a semiconducting substrate 200, using, for example, an epitaxy. This semiconducting layer 200 can, for example, be a doped layer N.

Figure 3A:
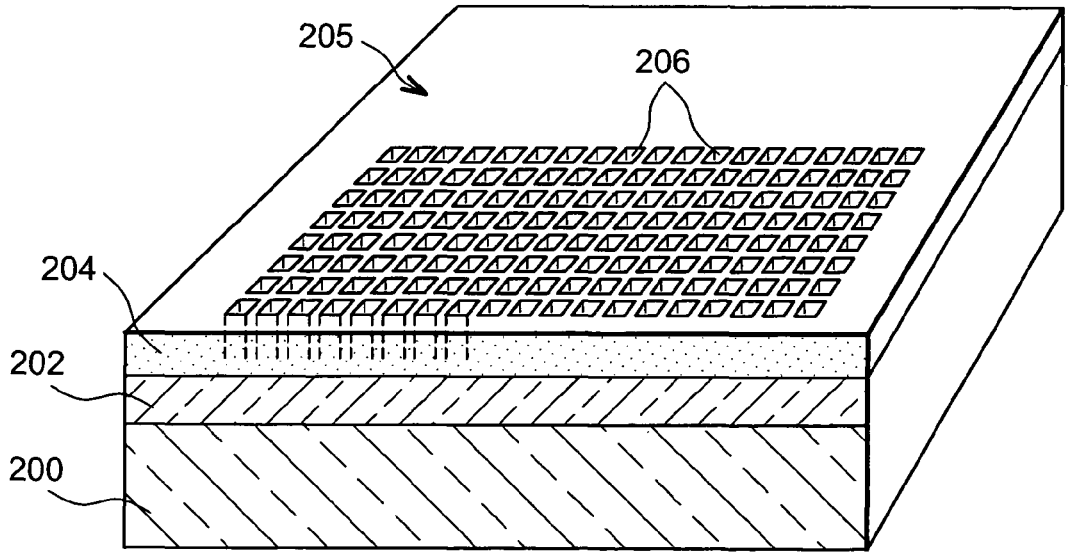
FIGS. 3A-3C, represent different steps of a second example of a method for production of a microelectronic device implemented according to the invention with an integrated antenna.

From a layer 204, comprising resist for example, and of a thickness on the order of 0.5 μm which is deposited on layer 202, a mask 205 is then formed on the semiconducting layer 202, for example using a photolithography method. The mask 205 has openings 206, the positioning in the layer 205 and the size of which are established respectively in accordance with a predetermined position relative to substrate 200, designed for a dipole intended to be formed in a layer above the semiconducting layer 202, and relative to a predetermined size or dimensions designed for this dipole (FIG. 3A).

Figure 3B:
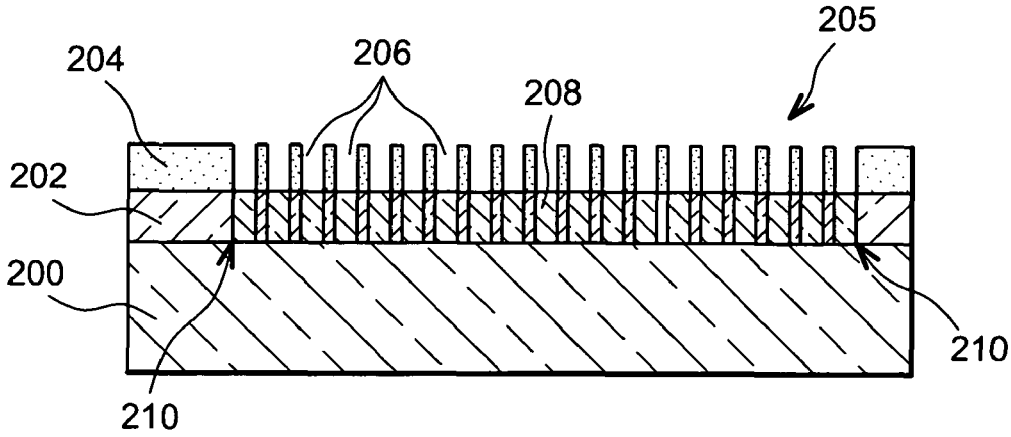
Figure 3C:
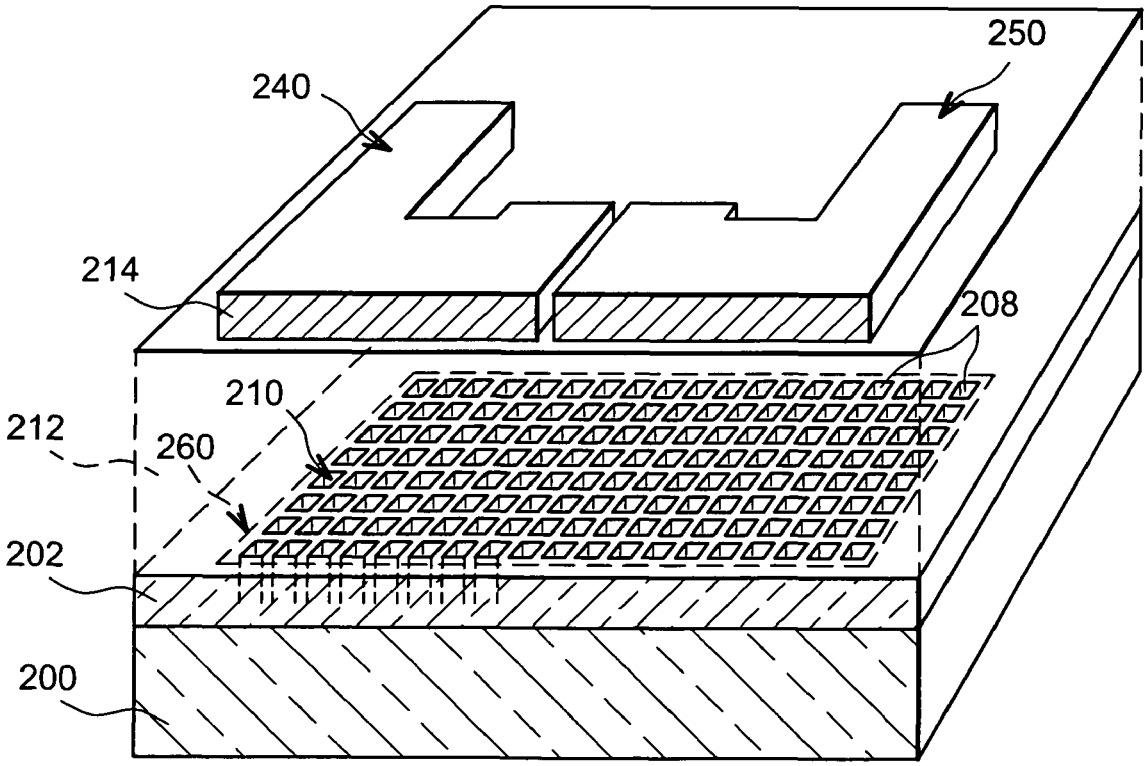

After this, through the openings 206 of the mask, one or more steps of doping of the doped semiconducting layer are undertaken to form junctions. The junctions can be PN junctions formed in P doped regions 208 fabricated in the N doped semiconducting layer 202, as an extension of the openings 206 (FIG. 3B).

According to a variant of embodiment, the semiconducting layer 202 can have been fabricated with another type of doping, for example a P type doping. The junctions can then be formed from regions 208 doped according to a type of doping different from that of the semiconducting layer 202, for example an N type doping. The mask 205 is then removed.

A method similar to the one described above in relation with FIGS. 1D-1E is then followed, in which the semiconducting layer 202 is covered with a set 212 (represented by dashed lines in FIG. 3C) of dielectric layers and conducting layers, in which a set of components and interconnections is fabricated, notably using traditional steps of photolithography and etching. Among the components fabricated can be components of an RF front-end device, intended to be linked to the antenna dipole.

A metal layer 214 is then deposited on the set 212. This metal layer 214 may, for example, be an aluminium-based layer of thickness on the order of 2 μm, or at least 2.5 μm. In the metal layer 214, two metal branches 240 and 250 of L-shaped parallelepipedic shape, similar to those described in relation with FIG. 2 (and referenced 140 and 150 in the same FIG. 2), are then fabricated, for example by photolithography.

Branches 240 and 250 are fabricated such that they are opposite or facing the semiconducting layer 202, in which are located junctions 210, such that each branch can be located opposite or facing one or more junction(s). Junctions 210 will be capable of limiting the circulation of current in the semiconducting layer 202 in a zone 260 (defined by dashed lines in FIG. 3C) located opposite or facing the dipole. According to a possible embodiment, the zone 260 can be much wider than metal branches 240 and 250.

In the examples of devices described above, the active semiconducting layer fabricated by epitaxy, located opposite the antenna, has structure or means enabling the circulation of current to be limited, at least in a certain zone opposite or facing the antenna dipole. These means or structure are not limited to a set of insulating blocks or junctions. The zone 260 of the semiconducting layer located facing the antenna may, according to another example, be a fully etched zone of the semiconducting layer and filled with dielectric material.

The device according to the invention is not limited to a massive semiconducting substrate commonly called a "bulk", covered with a semiconducting layer obtained by epitaxy. The semiconducting layer can be, for example, a semiconducting active layer of the substrate of SOI type (SOI for "silicon on insulator").

The shape of the antenna is not limited to the embodiments which have just been described. In a device fabricated according to the invention, the antenna can be, according to yet another example, an antenna of fractal shape comprising a dipole formed of wound conducting branches.

Furthermore, the device fabricated according to the invention is not limited to a dipole antenna, and can be applied to every type of antenna integrated in a chip.

That which is claimed is:

1. A method for fabricating a microelectronic device including at least one integrated antenna, the method comprising:

forming a structure for limiting circulation of current in a zone of a semiconducting layer, the structure for limiting circulation of current comprising at least one reverse biased junction in the zone of the semiconducting layer on a substrate; and forming a plurality of layers on the semiconducting layer including at least one antenna formed opposite the at least one reverse biased junction.

2. A method according to claim 1 wherein forming the structure for limiting circulation of current further comprises forming at least one insulating block in the zone of the semiconducting layer.

3. A method according to claim 1 wherein forming the structure for limiting circulation of current further comprises:

forming a mask on the semiconducting layer with at least one opening therein;

etching the semiconducting layer through the mask to form at least one opening in the semiconducting layer; and filling the at least one opening in the semiconducting layer with a dielectric material.

4. A method according to claim 1 wherein forming the structure for limiting circulation of current comprises:

forming a mask on the semiconducting layer with at least one opening therein; and doping the semiconducting layer through the mask to form the at least one reverse biased junction.

5. A method according to claim 4 wherein the semiconducting layer has a first type doping; and wherein doping through the semiconductor layer is a second type doping.

6. A method according to claim 1 wherein the semiconducting layer comprises at least one epitaxial layer.

7. A method according to claim 1 wherein the at least one antenna comprises a dipole including two conducting branches.

8. A method for fabricating a microelectronic device comprising:

forming a structure for limiting circulation of current in a zone of a semiconducting layer by forming at least one reverse biased junction in the zone of the semiconducting layer; and forming at least one antenna opposite the at least one reverse biased junction.

9. A method according to claim 8 wherein forming the structure for limiting circulation of current further comprises forming at least one insulating block in the zone of the semiconducting layer.

10. A method according to claim 8 wherein forming the structure for limiting circulation of current further comprises:

forming a mask on the semiconducting layer with at least one opening therein;

etching the semiconducting layer through the mask to form at least one opening in the semiconducting layer; and filling the at least one opening in the semiconducting layer with a dielectric material.

11. A method according to claim 8 wherein forming the structure for limiting circulation of current comprises:

forming a mask on the semiconducting layer with at least one opening therein; and doping the semiconducting layer through the mask to form the at least one reverse biased junction.

12. A method according to claim 11 wherein the semiconducting layer has a first type doping; and wherein doping through the semiconductor layer is a second type doping.

13. A method according to claim 11 wherein the semiconducting layer comprises at least one epitaxial layer.

14. A method according to claim 11 wherein the at least one antenna layer comprises a dipole including two conducting branches.

15. A microelectronic device comprising:

a substrate;

at least one semiconducting layer adjacent said substrate;

a structure for limiting circulation of current in a zone of said at least one semiconducting layer;

said structure for limiting circulation of current comprising at least one reverse biased junction in the zone of said at least one semiconducting layer; and a plurality of layers adjacent said at least one semiconducting layer including at least one antenna positioned opposite said at least one reverse biased junction.

16. A microelectronic device according to claim 15 wherein said structure for limiting circulation of current further comprises at least one insulating block in the zone of said at least one semiconducting layer.

17. A microelectronic device according to claim 15 wherein said at least one antenna comprises a dipole including two conducting branches.

18. A microelectronic device according to claim 15 wherein said at least one antenna is configured to operate at a frequency of at least about 10 GHz.

19. A microelectronic device according to claim 15 wherein said substrate has a resistivity of at least about 50 106 cm.

20. A microelectronic device comprising:

a substrate;

a semiconducting layer adjacent said substrate;

at least one reverse biased junction in a zone of said semiconducting layer; and at least one antenna opposite the zone of said semiconducting layer.

21. A microelectronic device according to claim 20 wherein said at least one antenna comprises a dipole including two conducting branches.

22. A microelectronic device according to claim 20 wherein said at least one antenna is configured to operate at a frequency of at least about 10 GHz.

23. A microelectronic device according to claim 20 wherein said substrate has a resistivity of at least about 50 Ωcm.

* * * * *

UNITED STATES PATENT AND TRADEMARK OFFICE

CERTIFICATE OF CORRECTION

PATENT NO. : 8,212,725 B2
APPLICATION NO. : 11/281744
DATED : July 3, 2012
INVENTOR(S) : Pons et al.

It is certified that error appears in the above-identified patent and that said Letters Patent is hereby corrected as shown below:

In the Claims:

| | |
|---|---|
| Column 9, Line 10 | Delete: "50 106"<br>Insert: --50-- |
| Column 9, Line 11 | Delete: "cm."<br>Insert: --Ω cm.-- |

Signed and Sealed this
Eighteenth Day of June, 2013

Teresa Stanek Rea
*Acting Director of the United States Patent and Trademark Office*